US007008280B1

(12) United States Patent
Taylor et al.

(10) Patent No.: US 7,008,280 B1
(45) Date of Patent: Mar. 7, 2006

(54) VISUAL TELLTALE INDICATOR WHICH INCLUDES A PRESSURE CONTROL DEVICE

(75) Inventors: Christopher J. Taylor, Kiel, WI (US); Edward J. Alyanak, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/062,138

(22) Filed: Feb. 21, 2005

(51) Int. Cl.
*B63H 21/10* (2006.01)

(52) U.S. Cl. ..... 440/88 T; 440/88 C
(58) Field of Classification Search ..... 440/2, 440/88 R, 88 T, 88 C
See application file for complete search history.

(56) References Cited

U.S. PATENT DOCUMENTS

| | | | | |
|---|---|---|---|---|
| 5,049,101 | A | 9/1991 | Binversie et al. | 440/88 |
| 5,061,214 | A * | 10/1991 | Monaghan | 440/88 R |
| 5,080,617 | A | 1/1992 | Broughton et al. | 440/2 |
| 5,671,906 | A * | 9/1997 | Rosen | 440/88 R |
| 6,551,154 | B1 | 4/2003 | Jaszewski et al. | 440/88 |

* cited by examiner

*Primary Examiner*—Lars A. Olson
(74) *Attorney, Agent, or Firm*—William D. Lanyi

(57) ABSTRACT

A telltale mechanism is provided with a valve that allows it to perform a dual function of providing a visual indicator of the operation of the cooling system of an engine and relieving water pressure within the cooling jacket of the engine. The valve provides a first fluid path through which a telltale stream is intended to flow and a second fluid path through which a pressure relief water stream is allowed to flow to maintain the pressure within the water jacket of an engine to a magnitude below a predetermined threshold.

18 Claims, 3 Drawing Sheets

VISUAL TELLTALE INDICATOR WHICH INCLUDES A PRESSURE CONTROL DEVICE

BACKGROUND OF THE INVENTION

1. Field of the Invention

The present invention is generally related to a telltale system for an outboard motor and, more particularly, to a telltale system that also serves the purpose of acting as a pressure relief mechanism for the cooling system of an engine of the outboard motor.

2. Description of the Prior Art

Those skilled in the art of marine propulsion systems, and particularly outboard motors, are familiar with the use of a telltale coolant stream that is emitted from the structure of the outboard motor to indicate that water is flowing properly through the cooling system of the engine. The visible stream allows a visual check to be made on the operation of the cooling system. Those skilled in the art of marine propulsion systems are also familiar with the use of various types of pressure relief valves.

U.S. Pat. No. 5,080,617, which issued to Broughton et al. on Jan. 14, 1992, describes a marine propulsion device with a directable telltale discharge. The device comprises a propulsion unit adapted to be mounted on the transom of a boat for pivotal movement relative thereto about a generally vertical steering axis. The propulsion unit comprises a lower unit rotatably supporting a propeller shaft adapted to support a propeller. A conduit is provided for discharging a fluid from the propulsion unit. A nozzle is provided for selectively varying the direction, relative to the lower unit, of the discharge stream.

U.S. Pat. No. 5,049,101, which issued to Binversie et al. on Sep. 17, 1991, describes a marine propulsion device with an arrangement for flushing an engine cooling jacket. The bracket structure of the marine propulsion device is adapted for connection to a boat transom and a propulsion unit is connected to the bracket structure for pivotal movement about a generally vertical steering axis. A conduit extends from the engine block and through an opening through a cover, or cowl, and includes a bore communicating with the cooling jacket and having an outer end with an internal thread. A plug is removably and threadably received in the threaded outer end portion of the conduit.

U.S. Pat. No. 6,551,154, which issued to Jaszewski et al. on Apr. 22, 2003, describes a combined telltale fitting with a water flushing attachment. A telltale system is provided for an outboard motor in which the telltale fluid conduit is connectable to an external water source, such as a water hose, and is extendable away from the cowl of the outboard motor in order to facilitate its use during a flushing operation. When not being used in the flushing procedure, the connector of the fluid conduit is snapped into position in connection with a cowl to maintain its position when used as a telltale port.

The patents described above are hereby expressly incorporated by reference in the description of the present invention.

It would be beneficial if a telltale system for an outboard motor could serve a dual purpose and also provide a pressure relief mechanism to maintain the pressure within the cooling system of an engine to a value below a predetermined magnitude.

SUMMARY OF THE INVENTION

A marine propulsion system made in accordance with a preferred embodiment of the present invention comprises an engine having a cooling jacket and an outlet conduit connected in fluid communication with a cooling jacket and configured to direct a stream of cooling fluid away from the cooling jacket. The outlet conduit is configured to define a first fluid path and a second fluid path. The second fluid path is dependent on a differential pressure between a first pressure within the cooling jacket and a second pressure downstream from the outlet conduit. A preferred embodiment of the present invention further comprises a valve which is connected in fluid communication with the outlet conduit. The valve is configured to control the magnitude of fluid flow through the second path as a function of the differential pressure between the first pressure within the cooling jacket and the second pressure downstream from the outlet conduit.

The valve comprises an opening and a closure mechanism which blocks the opening when the differential pressure is less than a preselected magnitude in a particularly preferred embodiment of the present invention. The valve can comprise a check ball mechanism. Alternatively, the valve can comprise at least one flexible petal that is moveable in response to the differential pressure. The first fluid path can be a telltale discharge from the cooling jacket and the second fluid path can be a pressure relief discharge from the cooling jacket.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
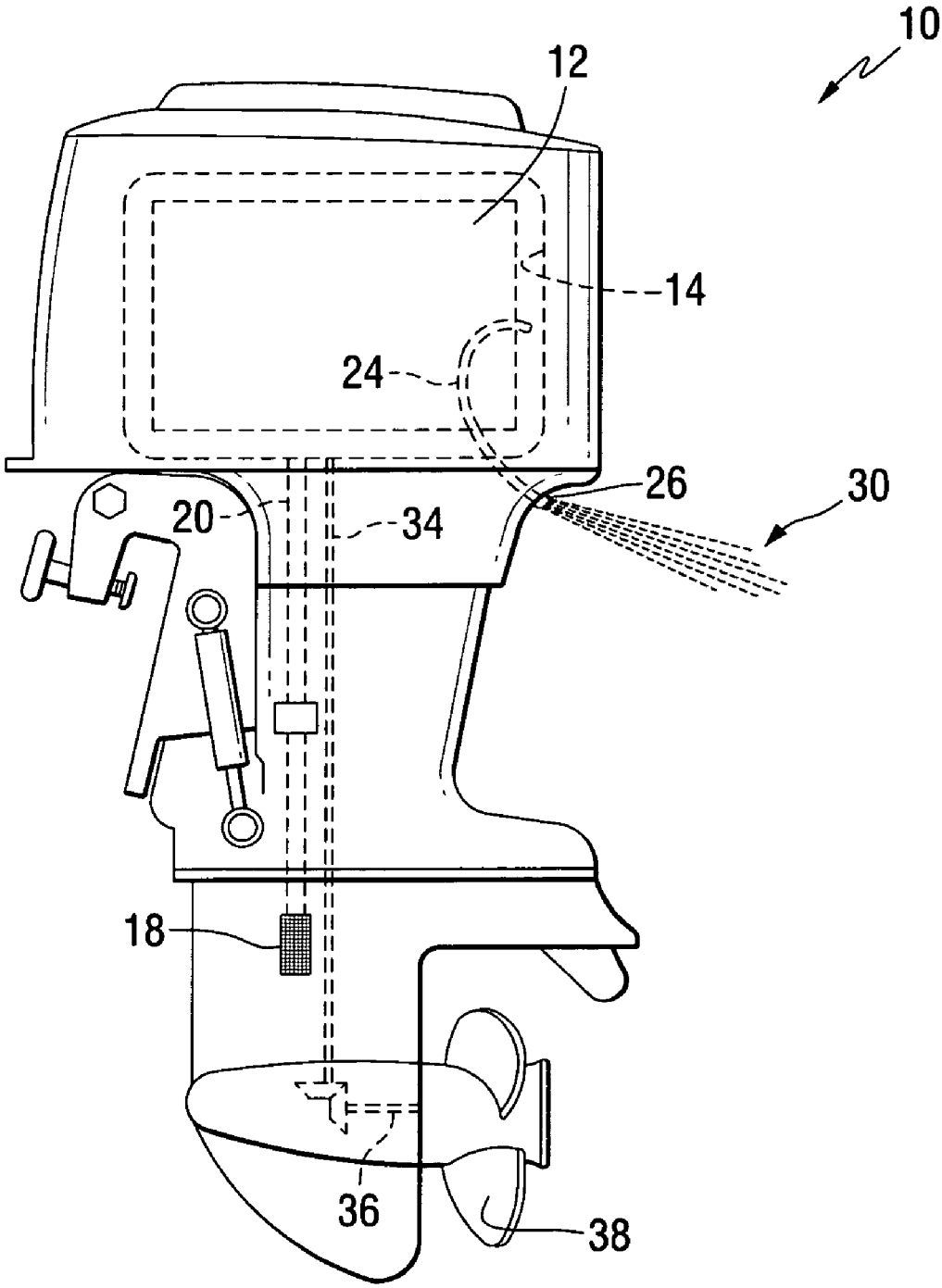
FIG. 1 PRIOR ART
FIG. 1 is a simplified representation of an outboard motor with a telltale system.

Throughout the description of the preferred embodiment of the present invention, like components will be identified by like reference numerals.

FIG. 1 illustrates an outboard motor 10 which has an engine 12 having a cooling jacket 14, which is symbolically represented in FIG. 1 surrounding the engine 12. It should be understood, however, that the cooling jacket 14 typically comprises a plurality of passages extending through the structure of the engine 12 and flowing in thermal communication with heat producing portions of the engine. In certain outboard motors, cooling water is drawn through an inlet, such as the screen 18, and directed upwardly through a conduit 20 and into the openings of the coolant jacket 14. An outlet conduit 24 can be provided to direct a portion of the cooling water to an outlet port 26 which directs a telltale stream 30 away from the outboard motor 10 in a way that provides a visual indication that water is flowing through the cooling jacket 14.

With continued reference to FIG. 1, dashed line 34 represents an axis of rotation of a driveshaft which is connected in torque transmitting relation with a crankshaft of the engine 12. Dashed line 36 represents the axis of rotation of a propeller shaft which is connected to a propeller 38 in a manner generally known to those skilled in the art. An outboard motor similar to that illustrated in FIG. 1 is described in detail in U.S. Pat. No. 6,551,154.

Figure 2:
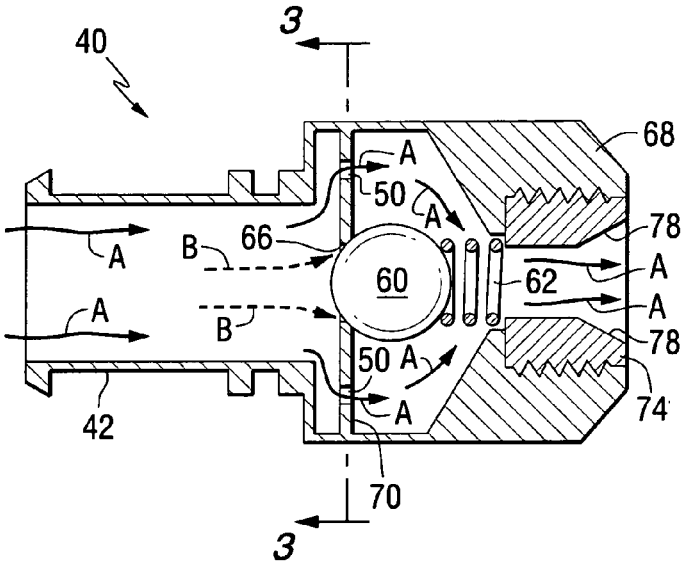
FIGS. 2–4 show one embodiment of a valve used in conjunction with a preferred embodiment of the present invention.
Figure 4:
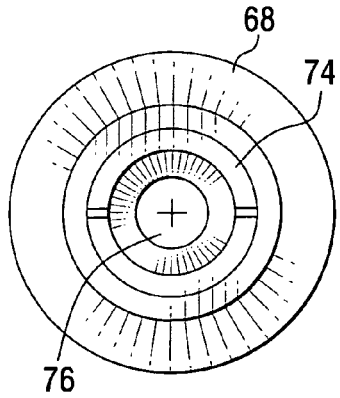
Figure 3:
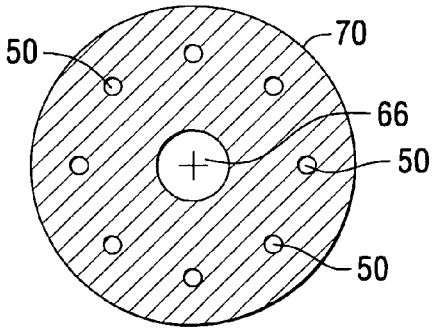
Figure 5:
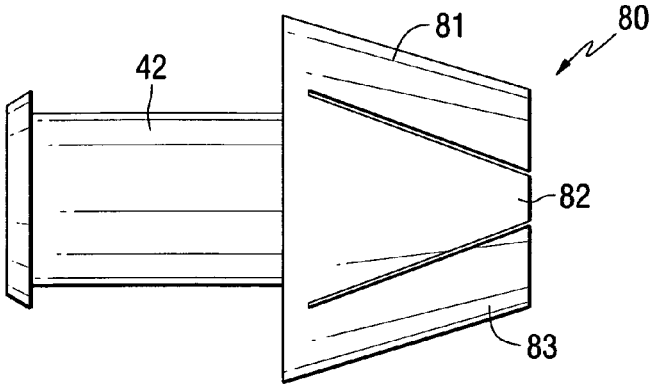
FIGS. 5–9 illustrate a second embodiment of a valve which is used in conjunction with a second preferred embodiment of the present invention.

FIGS. 2–4 show different views of one embodiment of the present invention. FIG. 2 is a section view of a valve structure that is attachable to an outlet conduit, such as conduit 24 described above in conjunction with FIG. 1. The valve 40 shown in FIG. 2 would typically be connected in fluid communication with the outlet conduit 24 at a location near the outlet port 26 illustrated in FIG. 1. The valve 40 has an inlet portion 42 which is attachable to a hose, such as the outlet conduit 24 described above. This connects the valve 40 in fluid communication with the cooling jacket 14 of the engine 12.

FIG. 3 is a section view of the valve 40 shown in FIG. 2 and FIG. 4 is an end view of the illustration in FIG. 2. With reference to FIGS. 2–4, the valve 40 allows the outlet conduit 24, with the valve 40 attached thereto, to define a first fluid path, represented by arrows A, which serves the telltale function described above. The first fluid path A flows through the valve 40 under all conditions in which water is properly flowing through the cooling jacket 14 described above. This provides the telltale function. A minimal pressure differential between the cooling jacket 14 and ambient pressure is sufficient to cause water to flow along the first fluid path A. The continuous flow of water through the first fluid path A is facilitated by the provision of openings 50 which are unrestricted and are not dependent on a preselected pressure differential between the pressure of water in the cooling jacket 14 and ambient pressure downstream from the valve 40. A second fluid path, illustrated by dashed line arrows B in FIG. 2, is dependent on the pressure within the cooling jacket 14 achieving a certain minimum magnitude. In the embodiment shown in FIG. 2, a check ball 60 and a spring 62 serve to block flow of fluid through opening 66 until the pressure in the inlet portion 42, and in the water jacket 14, exceeds a sufficient magnitude to provide a force against the ball 60 which compresses the spring 62 and partially opens a passage through opening 66. When ball 60 moves away from opening 66, the second fluid path B begins to flow in the direction represented by dashed line arrows B in FIG. 2.

With continued reference to FIGS. 2–4, the valve 40 comprises a housing structure 68 with a wall portion 70 through which the holes 50 and hole 66 are formed. A threaded insert 74 allows the internal structure to be assembled and provides an opening 76 through which both the first and second fluid paths, A and B, extend. The divergent portion 78 is provided to improve fluid flow through the structure.

With continued reference to FIGS. 2–4, it should be understood that the telltale function of the valve 40 is served by the first fluid path A which flows continually as long as some minimal differential pressure exists between the cooling jacket 14 and ambient pressure downstream from the valve 40. The second fluid path B flows only when the pressure within the cooling jacket 14 exceeds a predetermined magnitude which is sufficient to cause a force against the ball 60 that compresses spring 62 and at least partially opens opening 66. This second fluid path serves to act as a pressure relief mechanism when the pressure within the cooling jacket 14 exceeds a predetermined magnitude.

Figure 6:
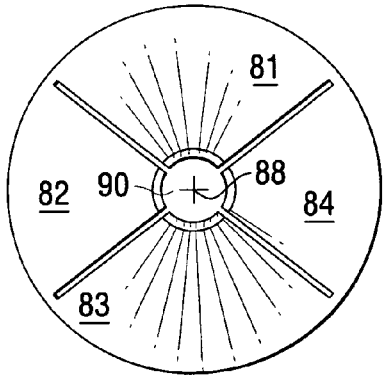

FIGS. 5–9 illustrate an alternative embodiment of the present invention. A valve 80 comprises an inlet structure 42 which is generally similar in size and shape to the inlet structure 42 described above in conjunction with FIG. 2. However, instead of providing a check ball mechanism, such as the ball 60 and spring 62 described above, the embodiment of the present invention shown in FIG. 5 utilizes flexible petals, 81–84, which are able to be deformed and bent away from a centerline 88 of the valve 80 when the pressure within the inlet structure 42 and within the water jacket 14 exceeds a preselected differential pressure relative to ambient pressure downstream from the valve 80. A central opening 90, illustrated in FIG. 6, provides a conduit through which the first fluid path can flow under all pressure differential magnitudes. When the petals, 81–84, deform and extend away from the centerline 80, a second fluid path is opened so that additional flow can pass through the valve 80 in response to an increase in the differential pressure. The second fluid path B is equivalent to the enhanced flow in addition to the first fluid path A.

Figure 7:
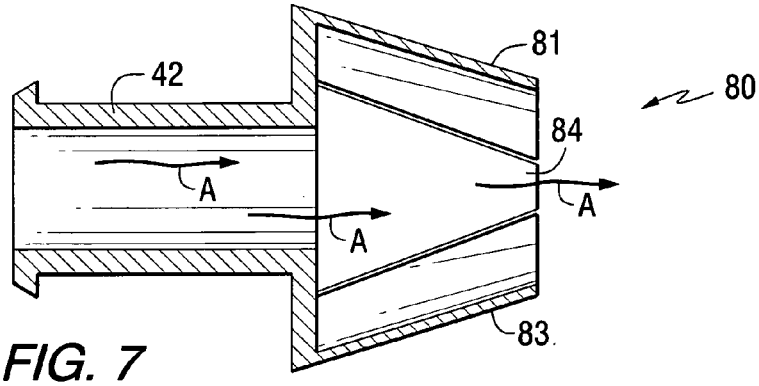

FIG. 7 is a sectional view of the valve 80 when it is in a closed position.

For reference purposes, arrows A represent the continuous flow of water along the first fluid path which serves as a continuous telltale mechanism for the purposes described above.

Figure 8:
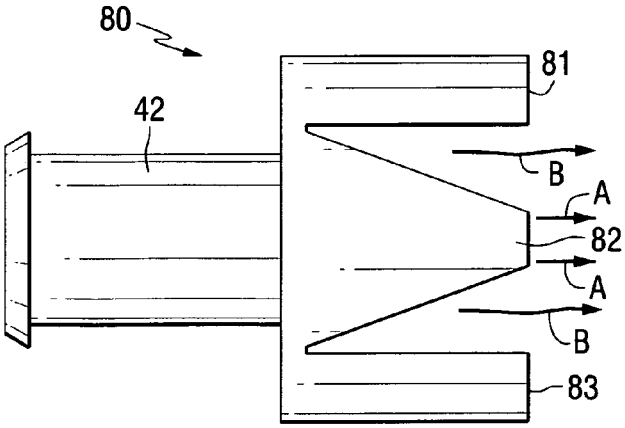

FIG. 8 illustrates the valve 80 when the petals are flexed outwardly away from the centerline 88 described above in conjunction with FIG. 6. The flexible characteristic of the petals, 81–84, allow the outlet opening of the valve 80 to be expanded radially to facilitate the flow of both the first and second fluid paths, A and B.

Figure 9:
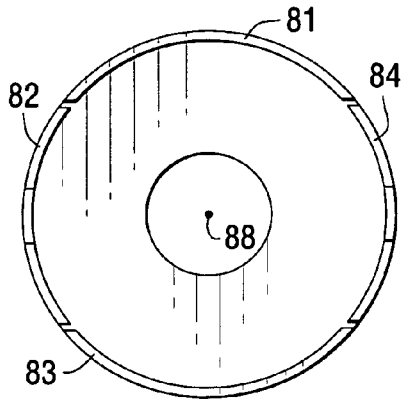

FIG. 9 is an end view of the valve 80 shown in FIG. 8. The petals, 81–84, are flexed radially outwardly from the centerline 88 to expand the opening to allow the additional flow of water through the second fluid path B. When the petals, 81–84, are flexed outwardly as shown in FIGS. 8 and 9, the telltale stream through the first fluid path A is combined with the enhanced pressure relieving stream through the second fluid path B. It should also be noted that the embodiment illustrated in FIGS. 5–9 is self-cleaning as a result of its structure. If debris moves into contact with the internal surfaces of the petals, 81–84, the internal pressure within the valve 80 will increase behind the debris and force it out of the valve by opening the petal structure.

With reference to FIGS. 2–9, it can be seen that the inclusion of a valve, 40 or 80, allows the telltale mechanism to serve a dual purpose of acting as a visual indicator to the operator of the marine propulsion system which illustrates that water is properly flowing through the cooling jacket 14 of the engine. The second function provided by the valve, 40 or 80, is to relieve the pressure within the cooling jacket 14 by expanding its flow capability in response to an increase in the differential pressure between the cooling jacket 14 and the ambient pressure downstream from the valve above a predetermined magnitude. Two embodiments of the present invention have been described and illustrated. However, it should be understood that alternative pressure relieving techniques can be used within the valve to accommodate the purposes of the present invention.

Although the present invention has been described in particular detail to illustrate two preferred embodiments, it should be understood that alternative embodiments are also within its scope.

We claim:

1. A marine propulsion system, comprising:

an engine having a cooling jacket; and an outlet conduit connected in fluid communication with said cooling jacket and configured to direct a stream of cooling fluid away from said cooling jacket, said outlet conduit being configured to define a first fluid path and a second fluid path for directing said cooling fluid away from said cooling jacket, said second fluid path being dependant on a differential pressure between a first pressure within said cooling jacket and a second pressure downstream from said outlet conduit.

2. The marine propulsion system of claim 1, further comprising:

a valve connected in fluid communication with said outlet conduit, said valve being configured to control the magnitude of fluid flow through said second path as a function of said differential pressure between said first pressure within said cooling jacket and said second pressure downstream from said outlet conduit.

3. The marine propulsion system of claim 2, wherein:

said valve comprises an opening and a closure mechanism which blocks said opening when said differential pressure is less than a preselected magnitude.

4. The marine propulsion system of claim 2, wherein:

said valve comprises a check ball mechanism.

5. The marine propulsion system of claim 2, wherein:

said valve comprises at least one flexible petal.

6. The marine propulsion system of claim 1, wherein:

said first fluid path is a telltale discharge from said cooling jacket.

7. The marine propulsion system of claim 1, wherein:

said second fluid path is a pressure relief discharge from said cooling jacket.

8. A marine propulsion system, comprising:

an engine having a cooling jacket;

a telltale conduit connected in fluid communication with said cooling jacket and configured to direct a stream of cooling fluid away from said cooling jacket, said telltale conduit being configured to define a first fluid path and a second fluid path for directing said cooling fluid away from said cooling jacket, said second fluid path being dependant on a differential pressure between a first pressure within said cooling jacket and a second pressure downstream from said telltale conduit; and a valve connected in fluid communication with said telltale conduit, said valve being configured to control the magnitude of fluid flow through said second path as a function of said differential pressure between said first pressure within said cooling jacket and said second pressure downstream from said telltale conduit.

9. The marine propulsion system of claim 8, wherein:

said valve comprises an opening and a closure mechanism which blocks said opening when said differential pressure is less than a preselected magnitude.

10. The marine propulsion system of claim 8, wherein:

said valve comprises a check ball mechanism.

11. The marine propulsion system of claim 8, wherein:

said valve comprises at least one flexible petal.

12. The marine propulsion system of claim 8, wherein:

said first fluid path is a telltale discharge from said cooling jacket.

13. The marine propulsion system of claim 8, wherein:

said second fluid path is a pressure relief discharge from said cooling jacket.

14. A marine propulsion system, comprising:

an engine having a cooling jacket;

a telltale conduit connected in fluid communication with said cooling jacket and configured to direct a visible stream of cooling fluid away from said cooling jacket, said telltale conduit being configured to define a first fluid path and a second fluid path for directing said cooling fluid away from said cooling jacket, said second fluid path being dependant on a differential pressure between a first pressure within said cooling jacket and a second pressure downstream from said telltale conduit; and a valve connected in fluid communication with said telltale conduit, said valve being configured to control the magnitude of fluid flow through said second path as a function of said differential pressure between said first pressure within said cooling jacket and said second pressure downstream from said telltale conduit, said valve comprising an opening and a closure mechanism which blocks said opening and said second path when said differential pressure is less than a preselected magnitude.

15. The marine propulsion system of claim 14, wherein:

said valve comprises a check ball mechanism configured to selectively block said opening and a spring to urge said check ball toward said opening.

16. The marine propulsion system of claim 14, wherein:

said valve comprises at least one flexible petal.

17. The marine propulsion system of claim 14, wherein:

said first fluid path is a telltale discharge from said cooling jacket.

18. The marine propulsion system of claim 17, wherein:

said second fluid path is a pressure relief discharge from said cooling jacket.

* * * * *